US006146285A

United States Patent [19]

Winslow

[11] Patent Number: 6,146,285

[45] Date of Patent: Nov. 14, 2000

[54] PUTTER ALIGNMENT DEVICE AND METHOD OF USING SAME

[76] Inventor: Jeffrey S. Winslow, 19626 Aderman Ave., #12, San Diego, Calif. 92126

[21] Appl. No.: 09/209,026

[22] Filed: Dec. 10, 1998

Related U.S. Application Data

[63] Continuation-in-part of application No. 09/020,453, Feb. 9, 1998.

[51] Int. Cl.[7] ..... A63B 69/36

[52] U.S. Cl. ..... 473/219; 473/240; 473/244; 473/241

[58] Field of Search ..... 473/240, 241, 473/226, 219, 227, 238, 239, 244, 231, 267, 268, 236, 251, 257; D21/751

[56] References Cited

U.S. PATENT DOCUMENTS

| | | |
|---|---|---|
| D. 245,438 | 8/1977 | Thiel . |
| D. 245,439 | 8/1977 | Thiel . |
| 1,327,171 | 1/1920 | Ruggles . |
| 1,556,062 | 10/1925 | Baugh . |
| 1,939,414 | 12/1933 | Sametz . |
| 2,463,798 | 3/1949 | Paisley . |
| 3,198,525 | 8/1965 | Smith . |
| 3,325,168 | 6/1967 | Fyanes . |
| 3,727,919 | 4/1973 | Scott . |
| 4,053,160 | 10/1977 | Salata . |
| 4,079,520 | 3/1978 | Davis . |
| 4,116,448 | 9/1978 | Crowe . |
| 4,601,472 | 7/1986 | O'Flanagan . |
| 4,712,798 | 12/1987 | Preato . |
| 4,720,110 | 1/1988 | Hurst . |
| 4,722,528 | 2/1988 | Tsao . |
| 4,789,158 | 12/1988 | Chiesa . |
| 4,844,468 | 7/1989 | Lee . |
| 4,953,866 | 9/1990 | Bang . |
| 5,071,129 | 12/1991 | Wilson . |
| 5,135,228 | 8/1992 | Hawkins . |
| 5,195,749 | 3/1993 | Ugarte . |
| 5,509,657 | 4/1996 | Guthry . |
| 5,640,777 | 6/1997 | Densberger . |

*Primary Examiner*—Sebastiano Passaniti
*Attorney, Agent, or Firm*—Bernard L. Kleinke; Higgs Fletcher & Mack LLP

[57] ABSTRACT

A putter alignment device is disclosed and includes a mounting frame for engaging a putter and for aligning the device relative to the putter face. A mirror frame having a mirror, employing a novel indicating line, supported thereby is coupled pivotally to the mounting frame for aligning the putter relative to a target. A securing arrangement is adapted to engage the mounting frame at a portion thereof, extend behind the putter, and engage another portion of the mounting frame to attach removably the putter alignment device on the putter. Inventive sight members facilitate positioning of the eyes of the golfer relative to the target line as a part of the alignment method.

18 Claims, 2 Drawing Sheets

PUTTER ALIGNMENT DEVICE AND METHOD OF USING SAME

CROSS-REFERENCE TO RELATED APPLICATIONS

This patent application is a continuation-in-part patent application of pending U.S. patent application Ser. No. 09/020453 filed Feb. 9, 1998, entitled "Putter Alignment Device and Method of Using Same," which is incorporated herein by reference.

BACKGROUND OF THE INVENTION

1. Technical Field

The present invention relates in general to a putter alignment device and a novel method of using it. The invention more particularly relates to a putter alignment device which attaches quickly and easily to a putter for facilitating the improvement of putting skills in accordance with a novel method.

2. Background Art

Many types of putter alignment aids were known for improving a putting game of a golfer, including the putter aids disclosed in the following U.S. Pat. Nos.: 1,327,171; 1,556,062; 2,463,798; 3,198,525; 3,727,919; 4,053,160; 4,079,520; 4,116,448; 4,601,472; 4,712,798; 4,720,110; 4,722,528; 4,789,158; 4,844,468; 4,953,866; 5,071,129; 5,195,749; 5,509,657; 5,640,777; U.S. Pat. No. Des. 245,438; and U.S. Pat. No. Des. 245,439.

For example, the following U.S. patents disclosed putter aids that attached to the shaft of a putter to help align the position of the putter to a position substantially normal to a path from the golf ball to a target such as a hole or pin: U.S. Pat. Nos. 3,198,525; 4,053,160; 4,079,520; 4,116,448; 4,789,158; 5,071,129; and 5,509,657. By securing the putter aid to the shaft, the golfer was able to look downwardly while in a putting stance to determine if the putter was properly positioned.

Although the disclosed putter aids enabled the golfer to adjust the putter to a desirable putting position before stroking a golf ball, the putter aids required a precise attachment to the shaft to ensure the putter aid was positioned properly relative to the club face of the putter. Where the putter aid was not properly positioned, the golfer was liable to obtain inconsistent and erroneous conditioning regarding the proper position of the putter.

Therefore, it would be highly desirable to have a new and improved putter alignment device which attaches quickly and easily to a putter, and which ensures the putter alignment device is properly positioned relative to the putter face. The putter alignment device can be used according to a novel method to permit the golfer to be conditioned for properly positioning the putter.

The following U.S. patents disclose putters having putting alignment devices integrated into theputterhead: U.S. Pat. No. 1,327,171; 2,463,798; 4,712,798; 4,722,528; 4,844,468; 4,953,866; 5,195,749; 5,640,777; 5,842,932; U.S. Pat. No. Des. 245,438; and U.S. Pat. No. Des. 245,439. By incorporating the putter alignment device into the putter head, the proper alignment of the putter alignment device relative to the putter face was substantially ensured without further adjustments of the putter alignment device.

While the disclosed putter aids did not require alignment of the putting aid relative to the putter face, and thus facilitated the conditioning of the golfer for a proper putting technique, the putter aids rendered the corresponding putters unsuitable for use during competitive play. In this regard, the use of such putter aids during a game of golf is not ordinarily permitted. Consequently, a putter having an integral putter aid would be utilized to practice putting, while another putter, without a putter aid, would be used to play a game of golf. As the physical properties of the putter with the putter aid were different from those of the putter without the putter aid, the conditioning received by the golfer using the putter and putter aid combination was not particularly relevant when a different putter is used during an actual game.

Therefore, it would also be highly desirable to have a new and improved putter alignment device which enables a golfer to use the same putter both for practicing desired putting strokes to condition the golfer, and for playing a game of golf.

Putter aids which can be removed from a putter to enable the putter to be used for both practicing and playing are disclosed in the following U.S. patents: U.S. Pat. Nos. 1,556,062; 3,727,919; 4,601,472; and 4,720,110. With the exception of U.S. Pat. No. 4,720,110, the patents disclosing removable putter aids require special mounting provisions incorporated into a putter to enable the putter aids to be secured to the putter while practicing putting strokes. As a result, the disclosed putter aids are not adapted for use with all types and styles of available putters.

The putter aid of U.S. Pat. No. 4,720,110 utilized a magnet to affix the putter aid to the putter face, thereby enabling the putter aid to be adaptable to many types and styles of putters. However, the magnetic attachment of the putter aid would be susceptible to readjustment during practice, and would require constant supervision to ensure proper alignment was maintained. Moreover, some modem putters have plastic inserts, and thus magnetic attachments would not be possible.

Therefore, it would also be highly desirable to have a new and improved putter alignment device that can be used with many types and styles of putters, and should stay in position during use. Such a putter alignment device should be relatively light in weight, and should be relatively inexpensive to manufacture.

All prior known devices employing mirrors for assisting a golfer to practice putting skills have fallen short of being satisfactory because they all lacked the ability to assist the golfer to align accurately and precisely the putter club face relative to the ball and the target. The main reason for this is that the golfer's eyes must be positioned directly above the target line and both eyes must be paralleled thereto to enable the golfer to obtain a correct visual perception of the target in the mirror. Thus, even though the conventional putting training device indicated that the club face was properly aligned with the ball and the target, if the eyes of the golfer are not positioned directly above the target line and parallel therewith the putter would not, in fact, be properly aligned. Thus, a subsequent swing would not necessarily achieve the desired result of the ball following the desired target line. This is because the initial impact of the putter head on the ball is not executed in the proper manner, even though the golfer may think or have the misconception that the putter is properly aligned.

Thus, it is critical to have a putter alignment device be able to help ensure that the eyes of the golfer be positioned directly and precisely above and parallel to the target line when aligning the putter with the ball and the target.

Such an alignment device should fit a variety of different sizes and shapes of putter heads in a very secure manner. In this regard, various different conventional putter heads have various different configurations which make the attachment of a universal device difficult, if not impossible. Once attached, it must be retained tightly and securely, but releaseably, in place in precise alignment with the hitting surface of the putter face.

SUMMARY OF THE INVENTION

Therefore, the principal object of the present invention is to provide a new and improved putter alignment device which is quickly and easily attachable to a putter in a proper position relative to the putter face according to a novel method and apparatus.

A further object of the present invention is to provide such a new and improved putter alignment device, which enables the same putter to be used for both practice and for playing.

Another object of the present invention is to provide such a new and improved putter alignment device, which is adapted for use with many types and styles of putters, and which is relatively lightweight and inexpensive.

A still further object of the present invention is to provide such a new and improved putter alignment device, which enables the user to align more accurately and precisely the putter relative to the target line with the eyes of the golfer positioned properly relative to the target line.

Briefly, the above and further objects of the present invention are realized by providing a new and improved putter alignment device which attaches to many types and styles of putters quickly and easily. Such a putter alignment device enables the same putter to be used for both practice and for play, and is relatively inexpensive and light in weight. The new and improved putter alignment device of the present invention facilities a more accurate and precise alignment with the eyes of the golfer positioned accurately and precisely aligned directly over and parallel with the target line.

A putter alignment device is disclosed and includes a mounting frame for engaging a putter and for aligning the device relative to the putter face. A mirror frame having a mirror, employing a novel indicating line, supported thereby is coupled pivotally to the mounting frame for aligning the putter relative to a target. A securing arrangement is adapted to engage the mounting frame at a portion thereof, extend behind the putter, and engage another portion of the mounting frame to attach removably the putter alignment device on the putter. Inventive sight members facilitate positioning of the eyes of the golfer relative to the target line as a part of the alignment method.

BRIEF DESCRIPTION OF THE DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
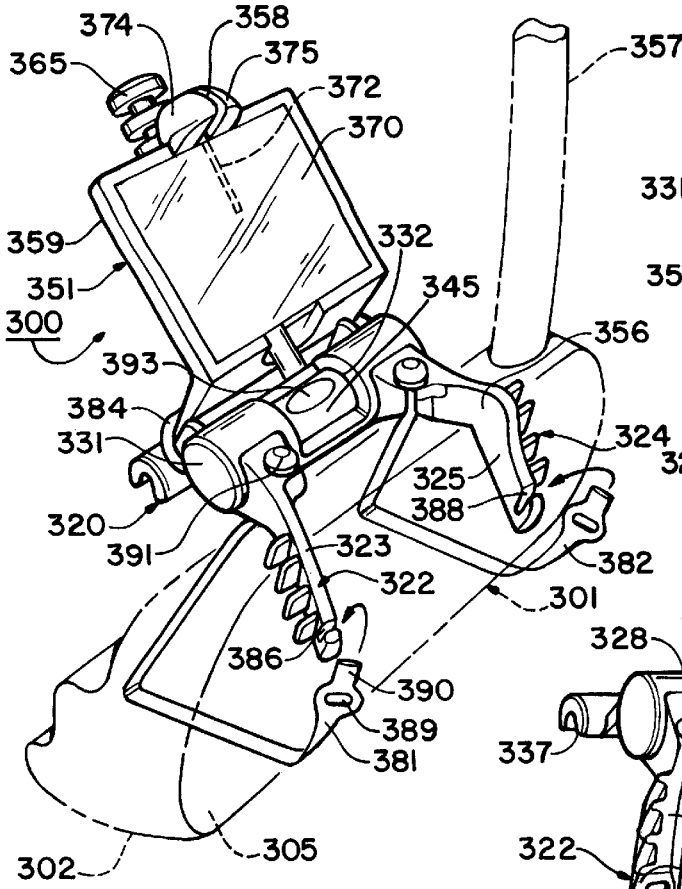
FIG. 1 is a pictorial view of a putter alignment device, which is constructed in accordance with the present invention, and which is illustrated as being mounted on a putter.

Referring now to the drawings, and more particularly to FIGS. 1–4 thereof, there is shown a putter alignment aid or device 300. The light weight device 300 is adapted to be mounted removably to a putter 301 having a putter head 302 with an associated putter face 305 (FIG. 1) for facilitating the proper alignment of the putter head 302 by a user (not shown) relative to a target (not shown). When used in accordance with the method of the present invention, the device 300 enables the user to be precisely and accurately "conditioned" during repeated practice for continually reproducing a proper putting stroke. The device 300 can easily be removed from the putter 301 so that the same putter can be used during the play of a game.

The device 300 includes a mounting frame assembly 320 for engaging the head 302 and for helping to secure the device 300 to the head 302 in a proper alignment relative to the face 305. Disposed within the mounting frame assembly 320 is a level indicating device 345 to indicate a heel/toe position of the head 302 when the mounting frame assembly 320 is mounted thereon. An L-shaped mirror frame assembly generally indicated at 351 is coupled pivotally to the mounting frame assembly 320 and supports a mirror 370 for reflecting an image of the target to facilitate aligning the putter 301, and the face 305, in a proper alignment position relative to the target. As shown in FIG. 1, a securing arrangement, including a pair of stretchable resilient elongated strips or bands 381 and 382, is coupled to the mounting frame assembly 320 and extends around the head 302 to secure the device 300 to the head 302 to enable the device 300 to be mounted to a variety of different types and kinds of putters due to the ability of the stretchable resilient bands to conform to the shape and configuration of the putter head.

The strips 381 and 382 enable the device 300 to be easily attached to the head 302 to facilitate the practice of aligning the putter 301 in the proper alignment position. The mounting frame assembly 320 is positioned on the head 302, directly in engagement with the face 305. Subsequently, the strips 381 and 382 are engaged with a portion of the mounting frame assembly 320, and are extended around the rear portion of the head, to be engaged with another portion of the mounting frame assembly 320 to enclose securely the head between the assembly and the strips 381 and 382. The strips 381 and 382 are preferably composed of thermal plastic elastomer material, and have a stretch ratio of between about three to one. More particularly, it has a ratio of about 2 ½ to one.

The device 300 can be removed quickly and easily by disengaging the strips 381 and 382 from the mounting frame assembly 320. Once the device 300 is removed, the user may utilize the putter 301 for participating in a game of golf in compliance with the rules of the game.

The mounting frame assembly 320 and the mirror frame assembly 351 are preferably constructed from a lightweight thermoplastic material to reduce substantially the weight of the device 300. In this way, the "feel" of the putter 301 is not substantially adversely affected by the weight of the device 300. Thus, the weight of the putter 301 during putting practice is substantially the same as the weight of the putter 301 during a game of golf.

In use, the device 300 is secured to the putter head 302, and the user assumes a stance while holding the putter 301 to address a golf ball (not shown) for putting the ball toward the target along a target line. The heel/toe position of the putter head 302 is adjusted until the level indicating device 345 indicates the head 305 is substantially horizontal. The putter head 302 is rotated while in its level orientation until the reflected image of the target provided by the mirror frame assembly 351 is seen by the golfer, wherein the putter face 305 is substantially perpendicular to the target line.

To facilitate the proper stance of the user with the eyes of the golfer directly over the target line and parallel thereto, the device 300 helps the golfer position his or her head with both eyes directly over the target line in accordance with an inventive sighting technique as hereinafter described in greater detail, so that the viewing of an image of the target line in the mirror 370 is highly precise and accurate without misconceptions as compared to prior known devices. It will be understood by one skilled in the art that the sequence of steps described above is only indicative of one possible sequence for aligning the putter 301, and that other sequences of steps are possible to obtain satisfactory results.

Figure 2:
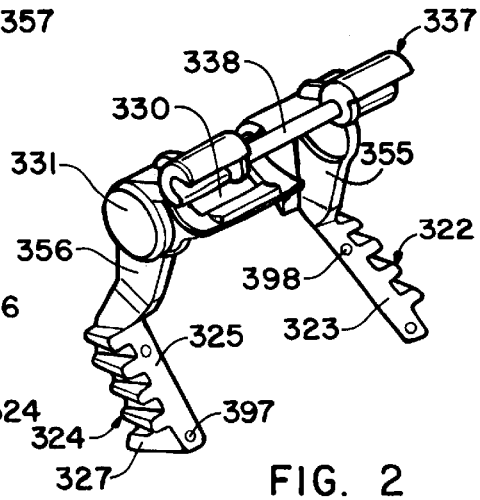
FIG. 2 is a pictorial view of the putter alignment device of FIG. 1, illustrating the lower portion thereof from the rear left side with the upper portion and vial omitted for sake of clarity.
Figure 4:
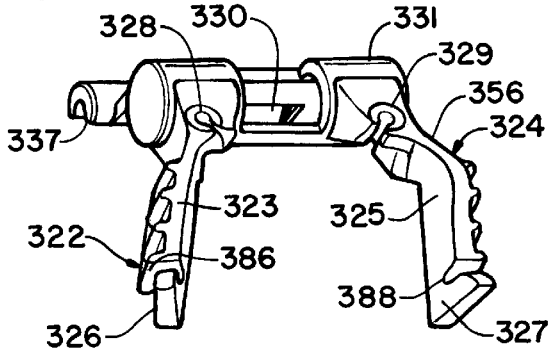
FIG. 4 is a pictorial view of the putter alignment device illustrating the lower portion thereof from the lower front with the upper portion and vial omitted for sake of clarity.
Figure 3:
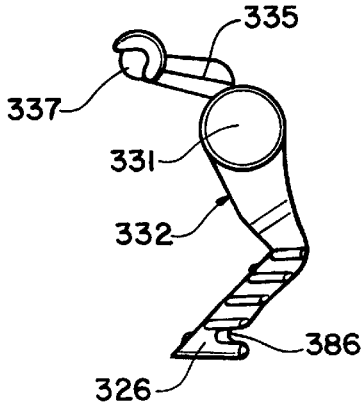
FIG. 3 is a right side elevational view of the putter alignment device of FIG. 1.

Considering now the putter alignment device 300 in greater detail, the mounting frame assembly 320 includes a pair of spaced apart or, L or C-shaped leg members 322 and 324 depending from a cylindrical housing 331. As best seen in FIGS. 2–4, a pair of parallel, spaced apart face engaging distal end portions 323 and 325 of the respective leg members 322 and 324 are adapted to engage the face 305 in a substantially flush manner at opposite sides of the central sweet spot of the putter face 305 so that the sweet spot can contact the ball without the leg members 322 and 324 interfering therewith. Consequently, the device 300 is properly aligned to the face 305, and thus the direct connection to the face ensures that the device 300 will remain in precise alignment with the putter head in accordance with the present invention.

As best seen in FIGS. 2 and 3, a plurality of projections such as projections 397 and 398, extend rearwardly from the respective leg members 324 and 322 for engaging the putter face so that the device 300 can accommodate various different conventional putter heads of a variety of configurations. Once the device 300 is attached to the putter head as indicated in FIG. 1, the device 300 is retained tightly and securely, but releaseably, in place in precise alignment with the hitting surface of the putter face.

The projections can accommodate various irregularities in the putter head configuration, since it is not required to have the entire frame engage the putter. Once the device 300 is secured in place, the relatively small circular projections, such as the projections 397 and 398, apply a high pressure per unit of area to the front face of the putter head. Thus, the device 300 is firmly attached and seated fixedly, yet releasably in place.

Hook members 326 and 327 of the distal end portions 323 and 325 cooperate with the rear ends of a pair of centrally disposed socket members 328 and 329 (FIG. 4) to engage and retain the strips 381 and 382 therebetween. The distal end portions 323 and 325 are spaced apart sufficiently to permit the "sweet spot" of the putter face 305 to be exposed when the device 300 is secured on the putter head 302.

As best seen in FIGS. 1, 2 and 4, the leg members 322 and 324 diverge away from one another at an angle therebetween. In this manner, the leg members 322 and 324 are widely spaced apart to expose more effectively the sweet spot. In this way, not only does the sweet spot remain unobscured by the device 300, but also the leg portions 323 and 325 serve as indicators for helping the golfer align the sweet spot with the ball. In this regard, the distal end portions 323 and 325 help define the sweet spot therebetween for the golfer. Additionally, as best seen in FIG. 2, the thigh portions 355 and 356 of the respective leg members 322 and 324 are inclined away and diverge in a coated manner from one another to position the device away from the hosel 357 to allow for a variety of different hosel locations.

The hook members 326 and 327 include respective notches or openings 386 and 388 in the respective front portions of the respective distal ends 326 and 327 for receiving and confining releaseably openings in the ends of the strips, such as the opening 389 of the strip 381 (FIG. 1). Integral tabs, such as a tab 390 of the strip 381 facilitates the manual engagement of the strip openings with the hook notches as indicted by the curved arrows in FIG. 1.

The strips 381 and 382 include at their respective opposite ends enlarged head, such as the head 391 (FIG. 1), for engaging releaseably the socket members 328 and 329, which are through holes in the upper portions of the respective leg members 322 and 324. In this regard, as indicated in FIG. 1, the securing strips, when securing the device 300 to the putter head, extend from the forwardly facing notches 386 and 388 under the putter head and along the rear side of the putter head and extend into and through the rear openings into the respective socket holes 328 and 329.

Figure 5:
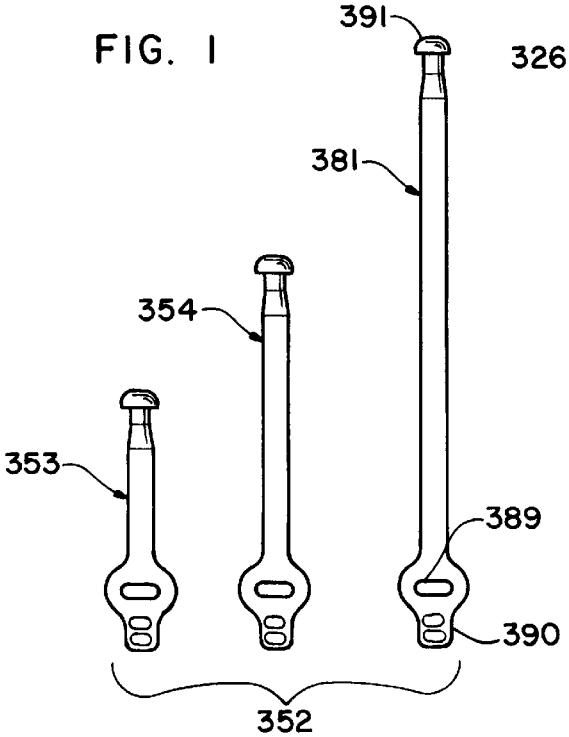
FIG. 5 is a pictorial view of a group of the securing devices for the device of FIG. 1.

As shown in FIG. 5, a kit 352 of a group of strips including the strip 381 and two similar strips 353 and 354 of different lengths enable the device 300 to be attached to a variety of different sizes and shapes of putter heads. It should be understood that the strip 382 and two other strips (not shown), like the corresponding strips 353 and 354, and are included in the kit 352.

The cylindrical housing 331 is substantially hollow, and includes a rear opening (FIGS. 2 and 4) to receive and retain the level indicating device 345 therein. A rectangular front opening 332 (FIG. 1) through the housing 331 enables the level device 345 to be observed by the user.

Figure 6:
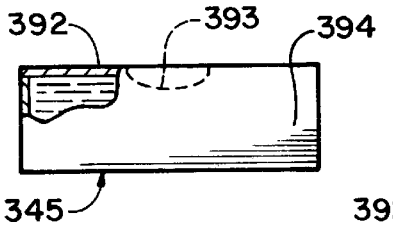
FIG. 6 is a fragmentary enlarged elevational view of the level indicating vial of the device of FIG. 1.
Figure 7:
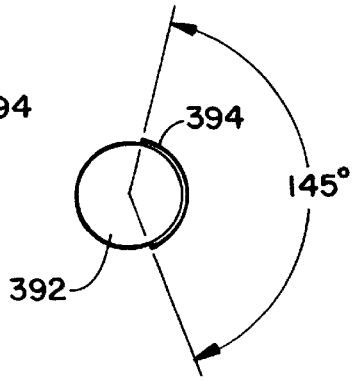
FIG. 7 is an end view of the vial of FIG. 6.

In accordance with the present invention, the level indicating device 345 includes a sealed liquid containing vial 392 having a level indicating bubble 393 (FIG. 1 and 6). The vial 392 is generally tubular in configuration and is circular throughout its axial length. The vial 392 is composed of transparent thermoplastic material to permit the bubble 393 to be viewed by the user. To increase greatly the visibility of the bubble 393 in accordance with the present invention, an opaque coating 394 overlies a back portion of the outer surface of the vial 392. The coating 394 is positioned in back of the bubble 393 to serve as a brightly contrasting background to facilitate the visualizing of the position of the bubble 393 relative to the opening 332.

The coating 394 conforms to the outer surface of the vial 392 and is C shaped throughout its axial length. The coating 394 extends over between about 123° and about 167° of the outer circumference of the vial 392. The most preferred angle is 145°. The coating is preferably white paint, but other coatings such as a paper sheet may be employed in accordance with the present invention. The end walls of the vial 392 may also be painted with an opaque paint.

A substantially flat member 335 (FIG. 3) extends rearwardly from the housing 331, and includes an end portion having an integral hinge pin member 37 spaced apart from the housing 331. A central hinge pin portion 338 (FIG. 2) is adapted to cooperate with the mirror frame assembly 351 to permit the assembly 351 to pivot relative to the assembly 320.

The mirror frame assembly 351 includes a hinge arrangement adapted to partially enclose the central hinge pin portion 338. A stretchable resilient endless band or loop 384 (FIG. 1) is disposed about the assembly 320 and the assembly 351 to urge resiliently the pivoting of the assembly 351 toward the assembly 320.

In order to adjust pivotally the assemblies 351 and 320 relative to one another for adjusting the relative position of the mirror 370 relative to the face 305, and thus to adjust positionally the mirror 370 face angle of the head 302, a set or adjustment screw 365 to position angularly the mirror 370 against the force of the band 384 relative to the putter face 305 to accommodate the associated face angle of the face 305. In this regard, the face angle of a putter can vary from putter to putter to suit the user. Depending upon the characteristics of the user, a putter may have a standard face angle, a negative face angle or a positive face angle. By rotating the screw 365 in either a clockwise or counterclockwise direction, the angular relationship of the assemblies 351 and 320 and thus the mirror 370, can be increased or decreased relative to the putter face 305 to position the mirror 370 for the particular face angle of the putter 301. This face angle adjustment is an initial adjustment which can be made when first mounting the device 300 to a particular putter. The adjustment screw serves as an adjustable stop since its tip end (not shown) engages the flat member 335 (FIG. 3) to drive the assembly 351 toward and away from the assembly 320 against the force of the band 384.

The mirror frame assembly 351 further includes a rectangular mirror support member 359 adapted to receive the mirror 370 therein. The mirror 370 is preferably secured to the member 359 by an adhesive, or by other suitable means.

As shown in FIG. 1, a pair of parallel spaced apart sight members 374 and 375 is disposed on the member 359 above the mirror 370, and is vertically aligned with a vertical center indicating line 372 disposed on the mirror 370. To align the putter face 305 to the proper alignment position, the user rotates the putter 301 about its shaft until the target image is in alignment with the center indicating line 372. By aligning the sight member 374 with the center indicating line 372, the user positions his or her eyes directly over the target line according to the desired putting stance. The user must level the putter head using the level vial 392 as well as utilizing the sight members 374 and 375 to properly alight the mirror with the target line to achieve the desired geometry to receive correct feedback and accurate perception.

Figure 8:
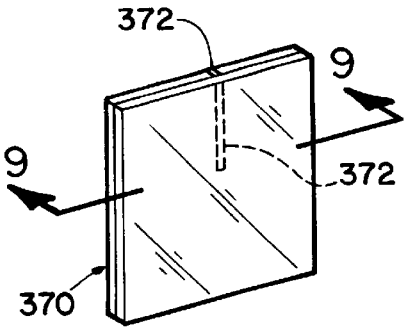
FIG. 8 is a pictorial view of the mirror of the device of FIG. 1.
Figure 9:
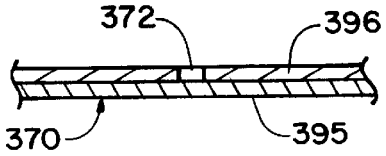
FIG. 9 is a diagrammatic sectional view of the mirror of FIG. 8 on line 9—9 thereof.

As seen in FIGS. 8 and 9, in accordance with the present invention, the center indicating line 372 is disposed on the back side of the mirror 370 to avoid displaying a reflected image of the line, which would otherwise provide an undesirable double image of the line. Such a double image prevents a precise alignment.

The mirror 370 includes a transparent plate 395 (FIG. 9) having the center indicating line 372 coated on the back side thereof in a precise central location. A reflective coating 396 (FIG. 9) covers over the back side of the plate 395 except for the line 372. Thus, the line 372 is viewed by the user through the transparent plate 395. As a result, the possibility of a reflected image of the line 372 is eliminated, and the line 372 can be applied to the plate 395 is a precise and accurate manner.

The coating 396 is first applied over the entire back side of the plate 395, and then an etched line (not shown) is formed or scribed in the coating 396. The line 372 is then formed by painting over the etched line.

For the purpose of facilitating the accurate sighting of the mirror 370 with both eyes of the golfer in proper alignment with the target line, the pair of generally vertically aligned and parallel spaced apart sight members 374 and 375 are disposed on the member 359 above the mirror 370. An elongated space 358 between the sight members 374 and 375 are aligned with one another to cooperate with the sight line 372 of the mirror 370 to facilitate the alignment of the eyes of the golfer with the device 300 and its center sight line 372 on the mirror 370. The sight members 374 and 375 substantially reduce alignment errors relative to the sight line 372 to ensure the eyes of the user are both positioned directly over the target line.

The sight members 374 and 375 enable the golfer to align properly his or her eyes directly over the target line by indicating to the golfer when the eyes are positioned improperly either forwardly or rearwardly relative to the ball, or outwardly or inwardly relative to the target line. The sight members 374 and 375 help indicate the forward or rearward positioning of the eyes (not shown). In so doing, the eyes are precisely and accurately positioned directly over the target line with the forward eye positioned properly relative to the golf ball. The exact position of the forward eye relative to the ball is determined by the adjustment of the mirror 370 relative to the putter face 305 by means of the adjustment screw setting. This setting may vary, depending upon the preference of a given golfer.

By utilizing the sighting members 374 and 375 in the manner as described, the golfer is ensured that his or her eyes are properly aligned with the mirror 370. Thus, when the golfer then visualizes the target and aligns the mirror sight line 372 with the target along the target line, there are no misconceptions in the mind of the golfer relative to the alignment of the putter face with the ball and the target line.

Considering now the sighting members 374 and 375 in greater detail, as shown in FIG. 1, the members 374 and 375 are in the form of a pair of blocks each having confronting oppositely-disposed parallel spaced-apart walls defining a narrow sight space 358. The space 358 is aligned precisely with the mirror sight line 372. The height of the members 374 and 375 are sufficient that the user gazing downwardly upon the device 300 must position his or her eyes over the members 374 and 375 before seeing the sight line 372 in the space 358 between the two sighting members 374 and 375. Additionally, the sight line 372, as shown in the drawings, extends only part way along the face of the mirror 370 such that the sighting members 374 and 375 completely obscure the line 372 from view unless and until the user positions his or her eyes directly vertically above the space 358 between the sighting members. In this regard, due to the short length of the sight line 372, it does not extend beyond the sighting members 374 and 375 when viewed from directly above the members.

Figure 10:
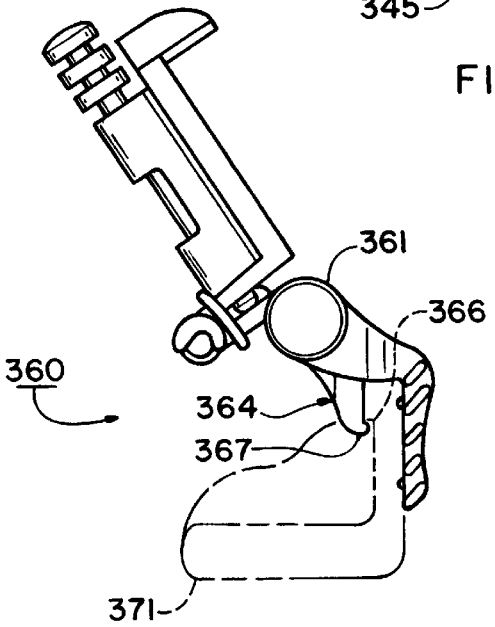
FIG. 10 is a side elevational view of another putter alignment device, which is also constructed in accordance with the present invention.
Figure 11:
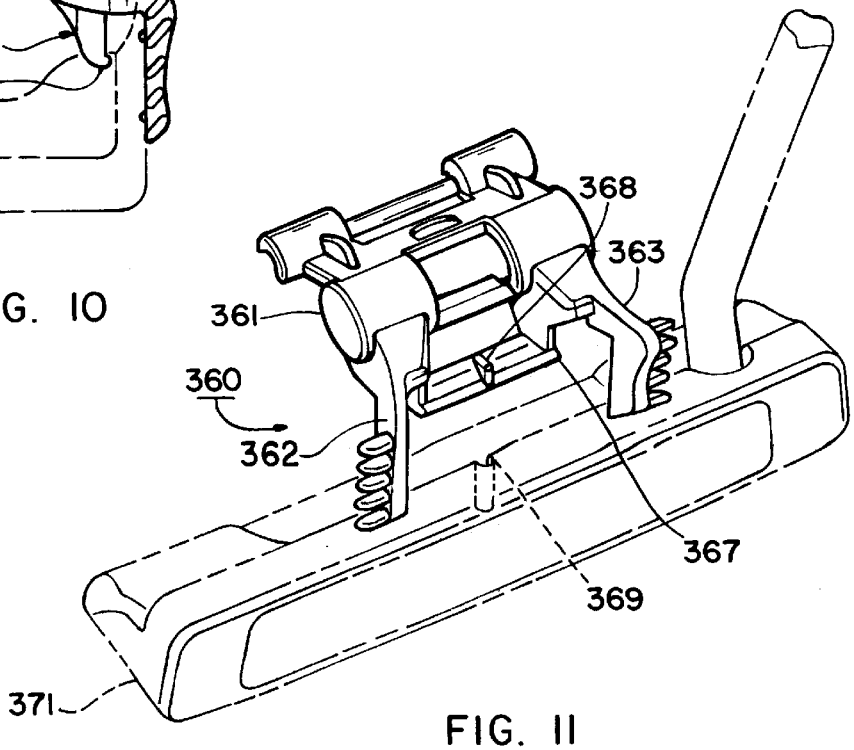
FIG. 11 is a pictorial view of the putter alignment device of FIG. 10, illustrating the lower portion thereof with the upper portion and vial omitted for sake of clarity.

Referring now to FIGS. 10 and 11, there is shown a putter alignment device 360, which is generally similar to the device 300 of FIG. 1, except the device 360 has a different manner of attachment to a putter head 371. The putter alignment device 360 includes a mounting frame assembly 361 having a pair of parallel spaced-apart leg members 362 and 363 which are generally similar to the leg members of FIG. 1, except that the leg members 362 and 363 do not have a lower hook portion for receiving the end of a strap. Instead, the mounting frame assembly 361 includes a downwardly depending clip member 364 which is parallel, spaced-apart from the leg members 361 and 362 as indicated in FIG. 10 for receiving a putter head undercut 366 on the back side thereof. In this regard, the mounting frame assembly 361 clips onto the top portion of the putter head 371 in a tight but releasable manner. In this regard, the leg members 362 and 363 are firmly pressed against the face of the putter as indicated in FIG. 2. A bottom edge forwardly projecting nib 367 of the clip member 364 fits under the undercut 366 to latch the frame assembly 361 firmly but releasably in position.

As shown in FIG. 11 which illustrates the bottom portion of the mounting frame assembly 361 in the process of moving downwardly into clamping engagement with the putter head 371, a locator detent 368 on the front centrally disposed portion of the depending clip member 364 is adapted to snap into a notch 369 in the back side of the putter head 371. In this manner, the alignment device 360 is precisely and accurately aligned with the hitting surface of the putter head 371.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A putter alignment device for use with a putter having a putter head with a face, to facilitate a proper alignment of the putter relative to a golf ball and a target, comprising:

frame means for engaging directly the putter head and having a pair of spaced-apart legs for engaging the face to permit the golf ball to be hit therebetween;

reflective alignment means mounted on said frame means for facilitating the alignment of the putter head by a golfer relative to the golf ball and the target;

resilient stretchable securing means for coupling to said frame means and for extending around the putter head for cooperating with said frame means to attach removably said frame means to the putter head; and said securing means being a pair of strips, both ends of each strip being attachable to said frame means but with at least one end of each strip for fixing releasable to said frame means.

2. A putter alignment device according to claim 1, wherein said securing means is composed of thermoplastic elastomer.

3. A putter alignment device for use with a putter having a putter head to facilitate a proper alignment of the putter relative to a golf ball and a target, comprising:

frame means for engaging directly the putter head;

reflective alignment means mounted on said frame means for facilitating the alignment of the putter head by a golfer relative to the golf ball and the target;

resilient stretchable securing means for coupling to said frame means and for extending around the putter head for cooperating with said frame means to attach removably said frame means to the putter head; and said securing means being at least one strip having a pair of attachment means disposed on opposite ends thereof for fixing releasable to said frame means;

having a center line indicator and sight means, said alignment means including a transparent plate having the line indicator coated on the back side thereof, and having a reflective coating disposed thereover.

4. A putter alignment device for use with a putter having a putter head to facilitate a proper alignment of the putter relative to a golf ball and a target, comprising:

frame means for engaging directly the putter head;

reflective alignment means mounted on said frame means for facilitating the alignment of the putter head by a golfer relative to the golf ball and the target;

resilient stretchable securing means for coupling to said frame means and for extending around the putter head for cooperating with said frame means to attach removably said frame means to the putter head; and said securing means being at least one strip having a pair of attachment means disposed on opposite ends thereof for fixing releasable to said frame means;

said frame means including a pair of widely spaced apart leg members diverging away from one another at an angle therebetween.

5. A putter alignment device for use on a head of a putter having a putter face with an associated face angle to facilitate a proper alignment of the putter by a user with a target along a target line, comprising:

a mounting frame adapted to be positioned on the putter head in accordance with the putter face angle;

reflective alignment means mounted on said frame and having an indicating line thereon having a certain thickness for indicating the alignment of the putter face;

sight means disposed on said reflective alignment means intermediate to its side edges for cooperating with said indicator means to enable the eyes of the user to be positioned over the target line in a forward and rearward orientation, said sight means having a pair of spaced apart confronting elongated walls defining an elongated sighting space therebetween;

said space being substantially the same size as said thickness of said indicating line to obscure said line from view unless and until the user positions his or her eyes vertically above said space; and said walls being narrowly spaced apart so that the indicating line can only be viewed when the eyes of the user are positioned directly vertically above said elongated sighting space.

6. A putter alignment device according to claim 5, further including a securing arrangement adapted to extend around the putter head and cooperate with said mounting frame for attaching removably said mounting frame to the putter head, said securing arrangement including a pair of stretchable strips, each having an opening at one of its ends and an enlarged head at its opposite end.

7. A putter alignment device according to claim 5, wherein said mounting frame and said sight means are constructed from a thermoplastic material.

8. A putter alignment device for use on a head of a putter having a putter face with an associated face angle to facilitate a proper alignment of the putter by a user with a target along a target line, comprising:

a mounting frame adapted to be positioned on the putter head in accordance with the putter face angle;

reflective alignment means mounted on said frame and having an indicating line thereon for indicating the alignment of the putter face;

sight means disposed on said mirror frame for cooperating with said indicator means to enable the eyes of the user to be positioned over the target line in a forward and rearward orientation, said sight means having a pair of spaced apart confronting elongated walls defining an elongated sighting space therebetween;

said walls being narrowly spaced apart so that the indicating line can only be viewed when the eyes of the user are positioned directly vertically above said elongated sighting space; and a level means for indicating a heel-toe position of the putter head, said level means including a liquid containing vial and an opaque portion on the back surface thereof to facilitate viewing a bubble within said vial.

9. A putter alignment device for use on a head of a putter having a putter face with an associated face angle to facilitate a proper alignment of the putter by a user with a target along a target line, comprising:

a mounting frame adapted to be positioned on the putter head in accordance with the putter face angle;

reflective alignment means mounted on said frame and having an indicating line thereon for indicating the alignment of the putter face;

sight means disposed on said mirror frame for cooperating with said indicator means to enable the eyes of the user to be positioned over the target line in a forward and rearward orientation, said sight means having a pair of spaced apart confronting elongated walls defining an elongated sighting space therebetween;

said walls being narrowly spaced apart so that the indicating line can only be viewed when the eyes of the user are positioned directly vertically above said elongated sighting space; and said mounting frame including a pair of spaced apart leg members adapted to engage the putter face to orient said reflective means relative to the putter face, said legs diverging away from one another at an angle therebetween.

10. A putter alignment device for use on a head of a putter having a putter face with an associated face angle to facilitate a proper alignment of the putter by a user with a target along a target line, comprising:

a mounting frame adapted to be positioned on the putter head in accordance with the putter face angle;

reflective alignment means mounted on said frame and having an indicating line thereon for indicating the alignment of the putter face;

sight means disposed on said mirror frame for cooperating with said indicator means to enable the eyes of the user to be positioned over the target line in a forward and rearward orientation, said sight means having a pair of spaced apart confronting elongated walls defining an elongated sighting space therebetween;

said walls being narrowly spaced apart so that the indicating line can only be viewed when the eyes of the user are positioned directly vertically above said elongated sighting space; and said reflective means including a mirror frame having a mirror mounted therein, said mirror including a transparent plate having a line indicator coated on the back side thereof, and having a reflective coating disposed thereon.

11. A putter alignment device for use on a head of a putter having a putter face with an associated face angle to facilitate a proper alignment of the putter by a user with a target along a target line, comprising:

a mounting frame adapted to be positioned on the putter head in accordance with the putter face angle;

reflective alignment means mounted on said frame and having an indicating line thereon for indicating the alignment of the putter face;

sight means disposed on said mirror frame for cooperating with said indicator means to enable the eyes of the user to be positioned over the target line in a forward and rearward orientation, said sight means having a pair of spaced apart confronting elongated walls defining an elongated sighting space therebetween;

said walls being narrowly spaced apart so that the indicating line can only be viewed when the eyes of the user are positioned directly vertically above said elongated sighting space; and integral hinge means for coupling pivotally said reflective means and said mounting frame.

12. A putter alignment device for use on a head of a putter having a putter face with an associated face angle to facilitate a proper alignment of the putter by a user with a target along a target line, comprising:

a mounting frame adapted to be positioned on the putter head in accordance with the putter face angle;

reflective alignment means mounted on said frame for indicating the alignment of the putter face;

said frame means including a pair of spaced apart leg members for engaging the putter face, the back side of each one of said leg members including at least one small projection to engage the putter face; and securing means for urging the back sides of the leg member in engagement with the putter face to cause each leg projection to engage the putter face with high pressure per unit of area.

13. A putter alignment device according to claim 12, wherein said legs are widely spaced apart and diverge angularly from one another to seat securely the frame on the irregular shaped putter head without blocking the sweet spot portion of the putter face.

14. A putter alignment device according to claim 12, wherein said securing means include at least one stretchable elongated strip having means defining an opening in one of its ends and an enlarged head at its opposite end.

15. A putter alignment device according to claim 14, wherein said frame means includes means defining a socket opening therein for receiving and retaining releasably the strap head, one of said legs including hook means for receiving and retaining said strip defining an opening to stretch said strip between said means defining a socket opening and the means defining an opening in its leg member.

16. A putter aligning device according to claim 12, wherein said securing means includes a kit comprising a group of elongated stretchable strips of varying lengths.

17. A putter aligning device according to claim 12, wherein said securing means including clip means.

18. A putter alignment device according to claim 12, wherein said securing means include a plurality of small projections on said mounting frame.

* * * * *